US009212622B2

(12) United States Patent
Kosheleff

(10) Patent No.: US 9,212,622 B2
(45) Date of Patent: Dec. 15, 2015

(54) PISTON PIN UNLOAD FOR OIL FILM RENEWAL

(71) Applicant: Patrick Andrew Kosheleff, Yankee Hill, CA (US)

(72) Inventor: Patrick Andrew Kosheleff, Yankee Hill, CA (US)

( * ) Notice: Subject to any disclaimer, the term of this patent is extended or adjusted under 35 U.S.C. 154(b) by 0 days.

(21) Appl. No.: 13/999,031

(22) Filed: Jan. 6, 2014

(65) Prior Publication Data

US 2015/0192089 A1 Jul. 9, 2015

(51) Int. Cl.

| | |
|---|---|
| ***F02F 3/00*** | (2006.01) |
| *F01M 11/02* | (2006.01) |
| *F02B 75/02* | (2006.01) |
| *F02B 3/06* | (2006.01) |

(52) U.S. Cl.

CPC ..... *F02F 3/0069* (2013.01); *F02F 3/0015* (2013.01); *F01M 11/02* (2013.01); *F01M 2011/025* (2013.01); *F02B 3/06* (2013.01); *F02B 2075/025* (2013.01); *F02F 3/00* (2013.01); *F05C 2201/021* (2013.01); *F05C 2201/0448* (2013.01)

(58) Field of Classification Search

CPC ..... F05C 2201/021; F05C 2201/0448; F02B 3/06; F02B 2075/025; F02F 3/00

USPC ..... 123/193.4

See application file for complete search history.

(56) References Cited

U.S. PATENT DOCUMENTS

| | | | | |
|---|---|---|---|---|
| 3,131,785 | A * | 5/1964 | Blank | 184/6 |
| 2006/0005793 | A1 * | 1/2006 | Ward | 123/48 B |

* cited by examiner

*Primary Examiner* — Lindsay Low
*Assistant Examiner* — Charles Brauch

(57) ABSTRACT

In a reciprocating engine piston, added equipment to renew the piston pin's oil film once per crankshaft rotation. The equipment is located between the connecting rod's small end and the underside of the piston crown. There is a plunger carrier with a plunger, and a saddle with a plunger bore. The saddle closely straddles the plunger carrier, maintaining the alignment of the arcuate plunger with the arcuate plunger bore, for a plunger stroke without friction. The small end's natural oscillation during crankshaft rotation powers the plunger's working cycle. There is an oil-filling stroke and a delivery stroke. The delivery is to the saddle's top, which is just below the piston crown. The oil pressure pushes upward on the piston crown, lifting the piston slightly and the piston pin bosses off the piston pin. In the small gap thus created, new oil can enter, recreating the oil film.

5 Claims, 7 Drawing Sheets

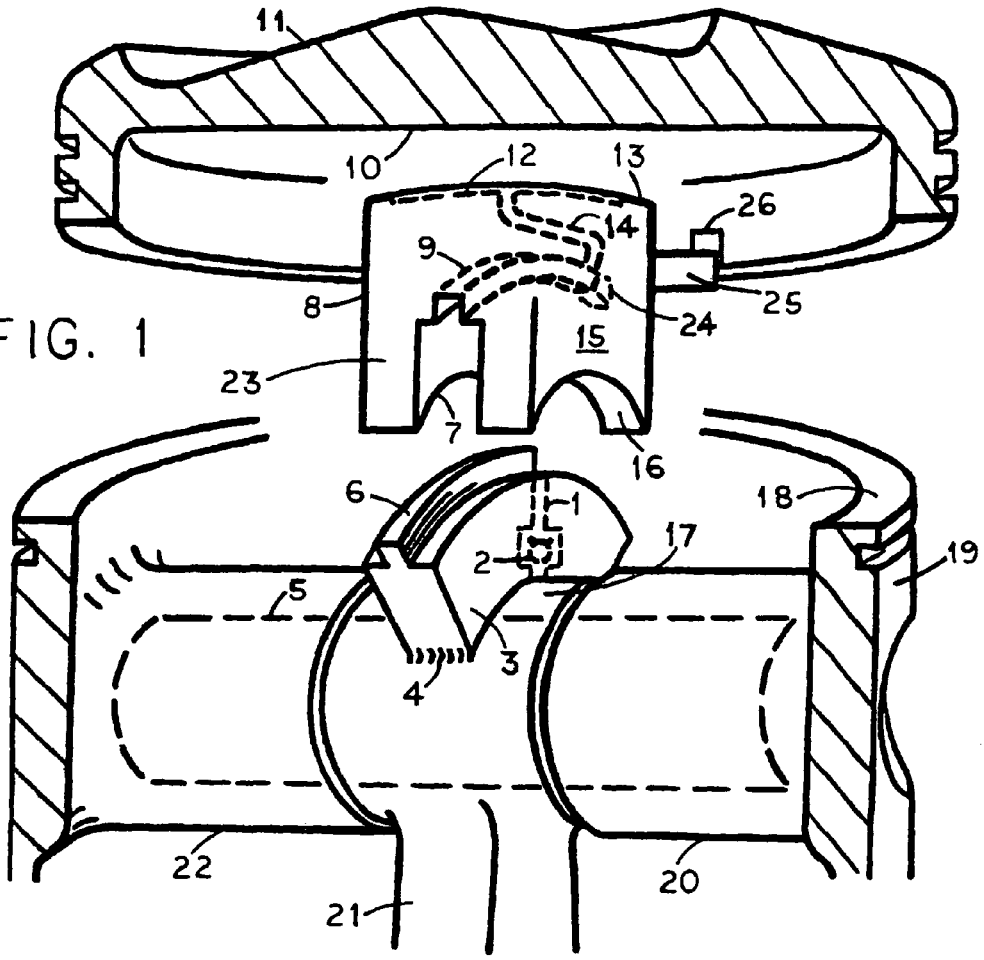
FIG. 1
FIG. 2
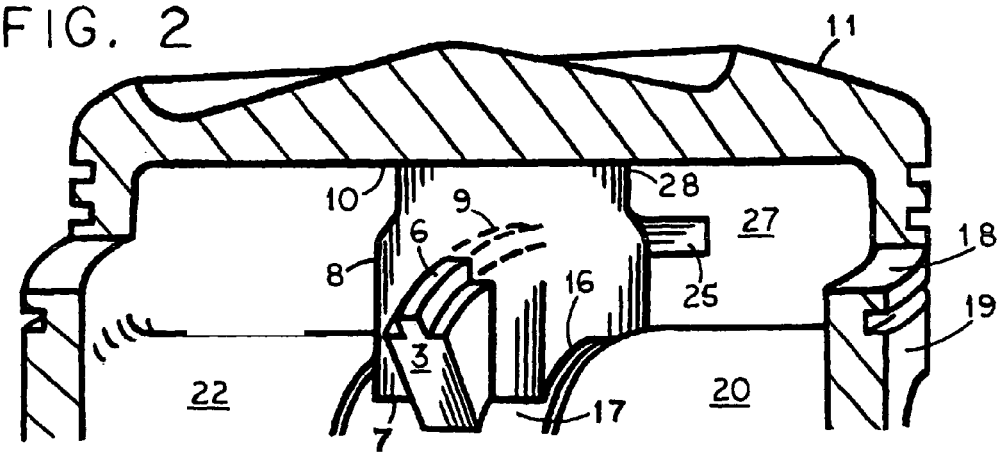

PISTON PIN UNLOAD FOR OIL FILM RENEWAL

BACKGROUND OF THE INVENTION

U.S. Pat. No. 3,056,638 for a reciprocating engine creates a recurring small gap below the piston pin to renew the oil film. It discloses a piston-and-connecting rod assembly. The upper end (the "small end") of the connecting rod is shaped not round but slightly eccentric to the axis of the piston pin. Once per crankshaft revolution, the eccentric meshes with a concave surface under the piston crown. This is caused by the natural oscillation of the connecting rod as its angularity changes continually during crankshaft rotation. The bulging portion of the eccentric acts as a cam when it passes under the concave surface, pushing up on it. The piston moves up slightly, as do the piston pin bosses. They pull the piston pin upward a little, creating increased clearance to the bushing in the rod small end. A renewal oil film can penetrate the increased clearance between the bottom of the pin and the bottom of the bushing. This restores the oil film between the piston pin and the bushing.

Our invention also unloads the piston pin, but the implementation is different. Hydraulic pressure is used to push upward on the bottom of the piston crown. The result is also different: The clearance obtained is between the piston pin and the piston pin bosses.

U.S. Pat. No. 3,027,207 will achieve the same result, but mechanically. The action is almost identical to that of U.S. Pat. No. 3,056,638 above. Clearance for a renewal oil film was not claimed, however, because his intent was direct bearing of the piston head on the connecting rod.

U.S. Pat. No. 3,200,798 for a variable compression ratio piston has an oil pumping action somewhat close to our own. A raised bump on the connecting rod small end pushes on a pump plunger. Pressurized oil is sent upward into a chamber under the moveable piston crown, causing it to lift. Quite similar to our mechanism. But his raised bump works as a cam, which is subject to wear. The push on our plunger is aligned with the back of the plunger.

In U.S. Pat. No. 2,066,489 the wear limitation is decreased by an arm pushing on the pump plunger. However, most of the contact includes sliding. An improvement is the arm shaped as a gear tooth. This has rolling contact at the pitch radius of mesh, a likely place for the point of highest load, therefore a good thing. But sliding wear remains at the other points.

SUMMARY OF THE INVENTION

A reciprocating engine piston with added equipment above the connecting rod and below the piston crown. The ultimate goal of the invention is to renew the oil film at the top of the piston pin once per revolution of the crankshaft. The proximate goal is to lift the piston slightly, using oil at high pressure pushing up on the bottom of the piston crown. This will cause the piston pin bosses to lift off the piston pin, creating a small gap between them through which refill oil can enter.

In the embodiment, the new equipment includes:

1) a plunger carrier with an arcuate plunger, and
2) a fixed saddle with an arcuate plunger bore. The nomenclature:

The plunger carrier is a tall curved ridge, the plunger is a slender curved rib and the plunger bore is a curved channel in the saddle.

The plunger carrier is located atop the small end of the connecting rod and bears the smaller plunger above it. The plunger carrier oscillates back and forth in time with the small end. The saddle with two uprights straddles the plunger carrier. The saddle's plunger bore accommodates the working stroke of the plunger. There is a check valve upstream of the plunger bore. The plunger pumps oil.

In operation, the plunger reciprocates within the plunger bore once per revolution of the crankshaft. On the outstroke, the plunger draws in some engine oil admitted by the check valve, filling the plunger bore. On the in-stroke, the check valve closes and the plunger delivers the captive, oil under high pressure to the saddle top below the underside of the piston crown. Check valve opening and closing are controlled by the reversing inertial forces generated by piston acceleration and deceleration during its travel.

The high-pressure oil pushes the piston crown upward slightly. The piston pin bosses are part of the piston structure, so they move up too. A small gap opens up between them and the piston pin, allowing oil to enter and renew the oil film.

The plunger and the plunger bore are circular arcs, for a mesh without friction. Close clearances between saddle and plunger carrier maintain plunger alignment. The saddle does not inhibit any motion of the plunger carrier in the sideways direction, in order to allow normal side play of the connecting rod.

The saddle's curved channel, which is the plunger bore, has a transverse cross-section resembling a square missing a side: Instead of a floor, the channel has a long opening. Refill oil is routed upwards to the plunger bore through the long opening. The circular top of the plunger carrier then functions as a moving floor, blocking by close clearance the leakage from the long opening.

The top of the saddle may include a shallow oil pan.

BRIEF DESCRIPTION OF THE VIEWS

FIG. 1 is a cutaway and exploded elevation of an engine piston and connecting rod assembly plus the new parts.

FIG. 2 is an elevation of the assembled new parts.

DETAILED DESCRIPTION

Figure 3:
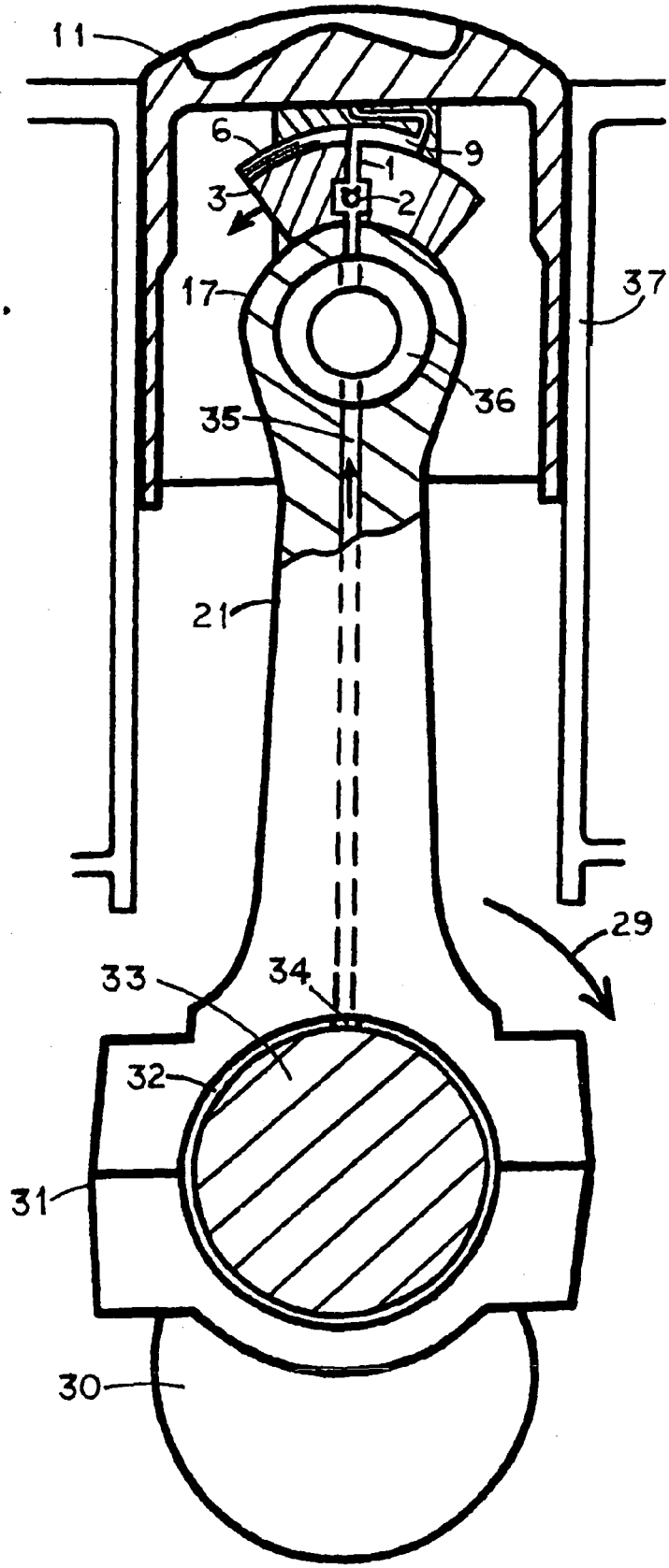
FIG. 3 is a partly sectional elevation of the new parts in action, with the engine components at Top Dead Center ("TDC").

FIG. 1 starts with a cutaway view of an engine piston 11, 19. The piston has been sliced into two pieces at parting line 18, mainly to expose the underside of piston crown 11. Piston skirt 19 has been sawed vertically, and the near half removed, to show piston pin bosses 20, 22 and the top 17 of connecting rod 21. The piston itself is almost unchanged from conventional ones, the only difference being flat underside 10 in piston crown 11. Underside 10 will closely approach top deck 13 of saddle 8, one of the new parts. The other new part is plunger 6, which will stroke back and forth in channel 9. Channel 9 is the plunger bore 9. Plunger carrier 3 positions plunger 6 correctly and transmits to it small end 17's oscillation.

Some background on reciprocating engines follows. Piston pin 5 is usually coated with a thin "squeeze film" of lubricating oil between it and piston pin bosses such as 22. In operation, the oil film compresses under load, protecting the parts. The invention aims to assist the periodic renewal of the oil film. This is especially useful in 2-stroke cycle engines with a high degree of boost. The working gas pressure on piston crown 11 never relaxes completely, eventually pushing the oil film out of existence. High wear is the result. The invention will physically lift piston pin bosses 20, 22 very slightly off the piston pin, allowing oil to enter the gap.

Some equipment to do that is seen in FIG. 1 as a plunger 6 which sweeps a plunger bore 9 of the same arcuate shape. Sweeping is preferably done with close clearance between plunger 6 and plunger bore 9, without friction. Plunger 6 will deliver oil under high pressure to saddle top deck 13. Saddle 8 doesn't move; its feet 7, 16 will rest on small end 17; piston crown 11 will rise a little instead. Piston pin bosses 20, 22 will move up too, attaining the proximate goal of the invention. Shallow pan 12 carved out of top deck 13 in FIG. 1 may be more practical than a flat top deck because the upward push may be sustained over a greater area.

In FIG. 1, saddle 8 is strong because it is one-piece. Plunger bore 9 and the large space below it can be made in one pass of a cutter wheel (not shown.) To finish that plunger bore 9, an arcuate plug at location 24 is fastened at the end of the cut for bore 9 in order to seal it there. Bore 9 is then able to become a chamber. Alternatively, if a slot cutter mills out the plunger bore, then an end plug at 24 can be just saddle material left in place. It seems to be a stronger solution.

Besides saddle 8, the new parts are actually a ridge 3, a rib 6 and a channel 9. To achieve a descriptive text, curved rib 6, tall ridge 3 and channel 9 are set aside, in favor of the words, "plunger 6, plunger carrier 3 and plunger bore 9" respectively. The latter set of three terms is more suggestive of the operation of the new parts as a pump.

Attention turns to the mechanics of the new equipment. The most important consideration is the motion of the parts. Plunger carrier 3 sits on top of small end 17. Carrier 3 is preferably unitary with small end 17, or made solid by, e.g., weld 4. Thus, plunger carrier 3 shares the ongoing oscillation of small end 17 during crankshaft rotation. The rhythmic motion of plunger 6 back and forth in plunger bore 9 is the pumping action which makes the invention work.

Oil feed to plunger bore 9 is by duct 1 connected to the engine's oil supply. Oil flow to duct 1 is under control of ball 2 in a check valve whose operation depends on the inertial forces generated by the piston's reciprocating motion.

Saddle 8 of FIG. 1 moves very little. Uprights 15 and 23 have circular bearing surfaces at bottoms 7 and 16. They sit on oscillating top 17 of rod 21 as it rocks underneath. Thus, rod top 17 must be machined round accurately. Rod top 17 is smooth on both sides of plunger carrier 3, being journals for saddle bottoms 7 and 16.

There are big reaction forces on saddle 8; plunger 6 will pump oil out of plunger bore 9 against great resistance from oil pressure. There will be a strong push on saddle 8 toward the right. In FIG. 1, that load is easily handled by strut 25 which will reach across to rest against contact patch 26. FIG. 2 shows the assembled piston, in which the end of strut 25 covers the contact patch as strut 25 reaches the inside wall 27 of the piston skirt. That absorbs directly the oil pressure push to the right on saddle 8. This desired result depends on strut 25 making constant contact with the wall without interfering with the slight upward motion (about 0.002") of the piston. With lubrication from the usual oil mist, it seems doable.

FIG. 2 shows piston 11, 19 whole again. Plunger 6 is in mesh with plunger bore 9 and ready for operation.

FIG. 2 shows a variation of saddle 8. Top deck 28 is narrower than the rest of saddle 8. In FIG. 2, top deck 28' is the width of the open space between piston pin bosses 20 and 22 if connecting rod small end 17 is not there. The open space is the room needed for a fly cutter (not shown) to pass upward in order to machine a circular spot very flat in underside 10. Then the parts are assembled. The tiny clearance desired between underside 10 and circular top deck 28 could then be accurate.

FIG. 3 includes the piston, connecting rod and crankshaft assembly. Piston 11 is at Top Dead Center ("TDC") in cylinder 37. Conventionally, this is at zero degrees of rotation of crankshaft main bearing journal 30. The big end 31 of connecting rod 21 is riding around rod bearing journal 33 (crankpin 33.) A known feature as drilled hole 34 admits part of the lubricating oil which was ducted to rod bearing 32 through the usual drilled holes (not shown) in the crankshaft. The oil, under pressure from the engine's oil pump, rises past drill hole 34 and up vertical duct 35; this duplicates FIG. 9 of SAE Paper 660344. The oil crosses drilled piston pin 36 and enters the check valve cavity containing ball 2.

As piston 11 rides up and down cylinder 37, its displacement versus time approximates ideal Simple Harmonic Motion. In this well-known trajectory, a repeating sine curve, the piston speed goes to zero for an instant at TDC, but the acceleration is greatest. That's because the motion is being reversed. In consequence, small ball 2 of the check valve hangs high, off its seat. The open valve lets the oil continue onward. It flows around ball 2 then through hollow duct 1. Connecting rod 21 pivot is piston pin 36. With crankpin 33 rotating to the right (arrow 29), small end 17 is turning counterclockwise, taking plunger 6 and plunger carrier 3 with it (small arrow.) Plunger 6 is leaving plunger bore 9, creating new volume behind the plunger. The oil keeps going and fills that volume too. This is the refill portion of the plunger cycle.

Figure 4:
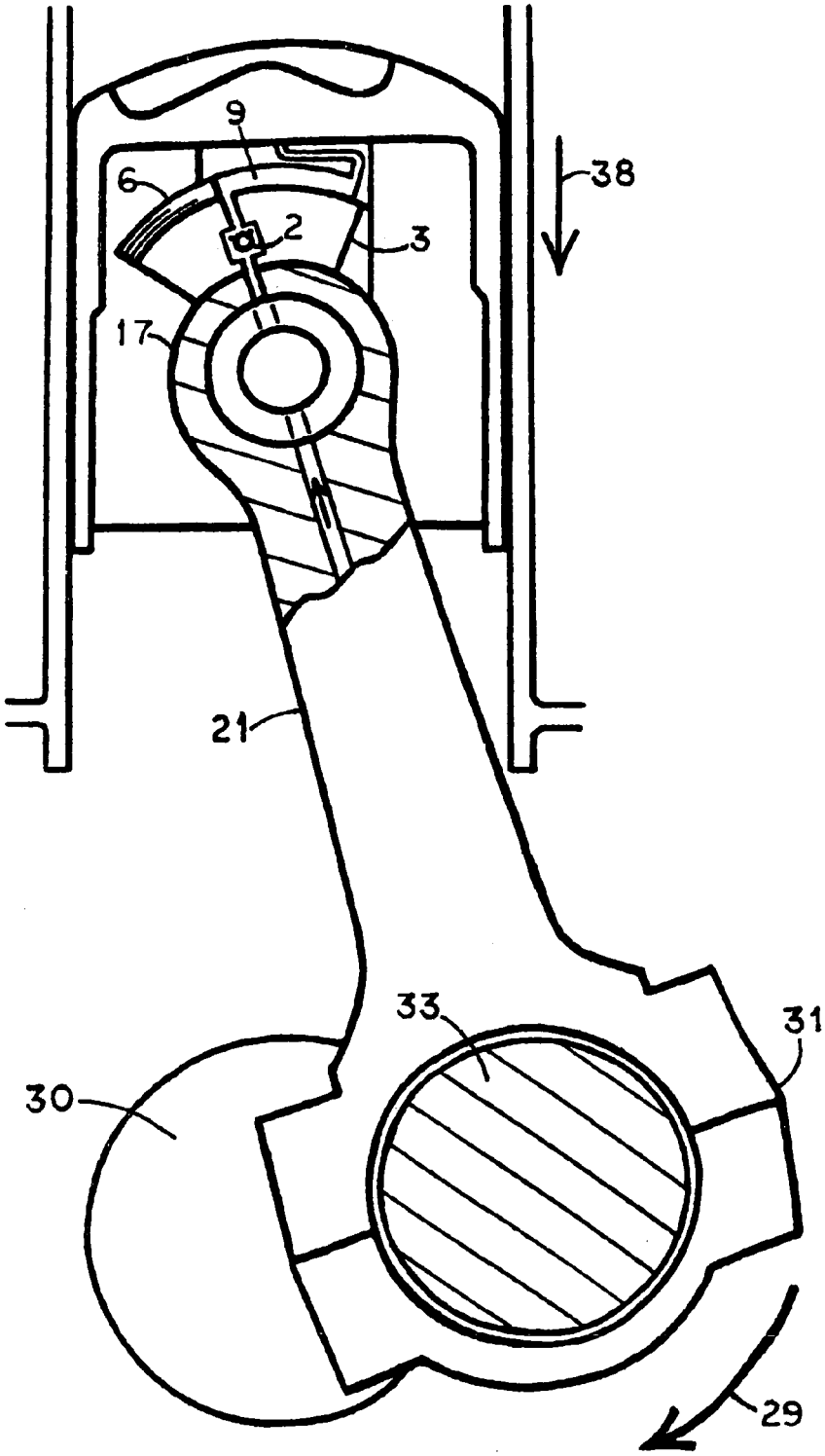
FIG. 4 is similar to FIG. 3 but at 80° after TDC.

FIG. 4 shows rod journal 33 at 800 of rotation past TDC. Rod big end 31 is on one side of crankpin 33's circular orbit. Piston displacement versus time is only approximately Simple Harmonic Motion, because of connecting rod angularity. Piston speed 38 is very high, and acceleration is near zero. For an instant, the piston is coasting at high speed (arrow 38.) Small ball 2 of the check valve has no cause to move from its high perch yet, although that will soon change. But for now, plunger 6 has retracted the maximum out of plunger bore 9. Oil has filled plunger bore 9. This ends the refill duration.

Figure 5:
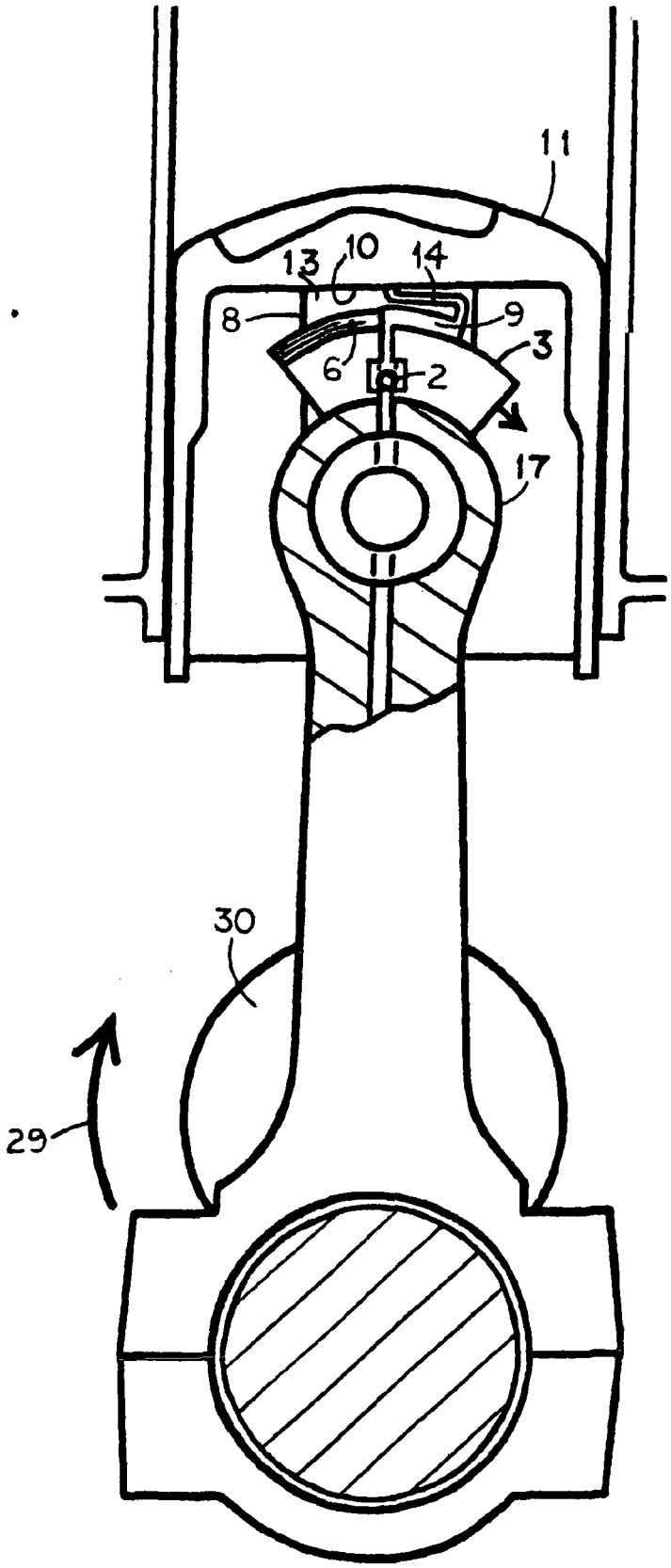
FIG. 5 is similar to FIG. 3 but at 180° after TDC.

FIG. 5 shows the piston at Bottom Dead Center, 180 degrees of crankshaft journal 30 rotation beyond TDC. In FIG. 5, small end. 17 is now turning clockwise, taking plunger carrier 3 to the right (small arrow.) The volume of plunger bore 9 decreases. The oil cannot flow backward because check valve ball 2 has dropped to its seat. This is because of the deceleration of the piston. Referring to Simple Harmonic Motion again, the piston is momentarily stopped, but the downward acceleration is greatest (motion reversal.). Oil pressure also keeps ball 2 on its seat.

With backflow blocked, the captive oil in plunger bore 9 flows up duct 14 and is delivered to the flat underside 10 of piston crown 11. At the moment there is no space visible yet between flat underside 10 and top deck 13. Oil pressure pushes equally on floor 10 and top deck 13. Saddle 8 can't move downward, so piston crown 11 moves upward very slightly instead. (It is noted that plunger 6 may have been sized much larger, for visibility's sake, than it needs to be to pump enough oil to move piston crown 11 incrementally. In any case, a small movement is the proximate goal of the invention.) FIG. 5 shows the middle of the working stroke of plunger 6.

Figure 6:
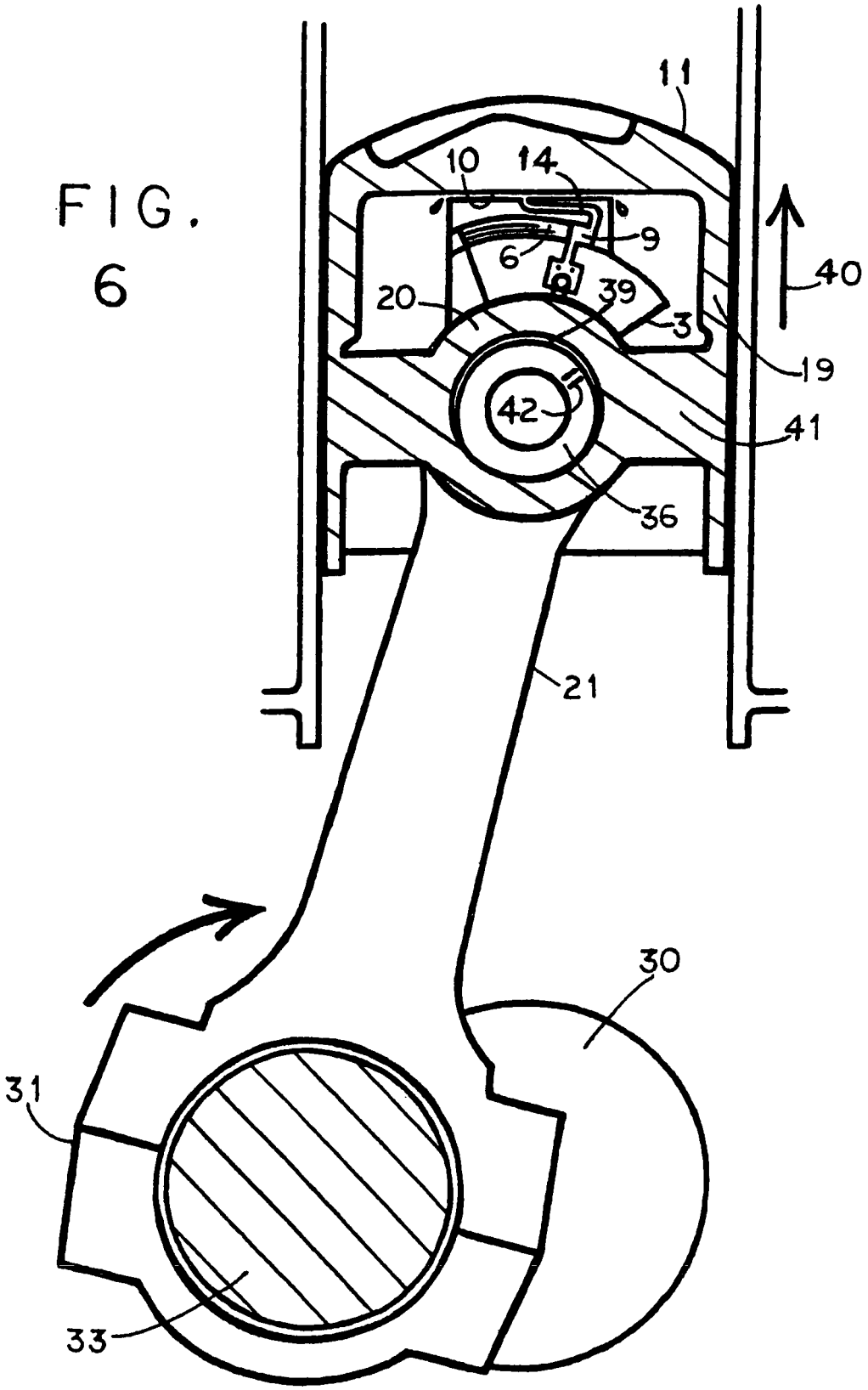
FIG. 6 is similar to FIG. 3 but at 270° after TDC.

FIG. 6 shows the parts at ¾ of one complete revolution of crankshaft journal 30: 270° beyond TDC. Connecting rod big end 31 is on the other side of crankpin 33's circular orbit. Piston 11 "coasts" (arrow 40) at high speed. An important visual change is that ringshaped item 20 is a piston pin boss, not part of connecting rod 21. Plunger carrier 3 is at the end of its turn to the right. Plunger 6 is similarly at the end of its stroke. The oil, formerly in plunger bore 9, has now been pushed out, upward through duct 14 and against underside 10. Steady push on floor 10 has moved piston crown 11 upward visibly now (some 0.002"in reality.) Piston pin boss 20 is an integral part of the piston and moved up slightly too. A small gap 39 (again 0.002") appears between piston pin boss 20 and the top of piston pin 36. This is the goal of the invention. The oil film between piston pin boss 20 and piston pin 36 can renew itself through gap 39.

Capillary action on the usual oil mist rising from the crankcase is the most common way to renew this oil film. But pressure feed is also possible, using small hole 42 drilled in piston pin 36. Two small holes 42 actually, one for each piston pin boss 20, 22. Recall that the interior of piston pin 36 must already be under pressure in order to convey upward the oil.

In FIG. 6, web 41 is meant to suggest the unitary relation of piston pin boss 20 to piston skirt 19. Then when piston crown 11 moves up its 0.002" or so, piston pin boss 20 moves up too.

It should be noted that the gas loads are already of some magnitude in FIG. 6, where compression of the charge on the up-stroke of the piston has already started. Therefore, the oil pressure under floor 10 may have to be quite high to move the piston opposed by the gas load on piston crown 11. Two things can now be observed.

First, the gas load of compression may be so large at the point of FIG. 6 that the oil film was actually rebuilt earlier. This is easily achieved. At Bottom Dead Center, the gas load is the smallest. That's because the gas load is only the boost pressure, not the compression pressure. Thus, gap 39 from FIG. 6 may quite reasonably appear at Bottom Dead Center instead. The timing of events shown should not be interpreted too literally. Oil-filled gap 39 seen in FIG. 6 may in fact be squeezing down from compression gas load by the time of FIG. 6. It will not matter. Squeeze film action on a piston pin is a well-tested phenomenon.

Secondly, the pumped oil could reach very high pressure, but can't be allowed to break something. A possible solution is to add a conventional spring-loaded pressure relief valve (not shown).

We used inertial force periods to lift the check valve ball off its seat, then put it back on its seat. The timing of these events coordinates well with the out-stroke and in-stroke of plunger 6. The rocking of the plunger is due to the changing angle of connecting rod 21. Angularity of the connecting rod changes the timing of events. The sine curve is distorted: The top half gets narrower and the bottom half gets wider.

With connecting rod 21, upward inertial force ends around 80° after TDC. A similar narrowing duration exists on the other side of connecting rod 21's swing. Thus, the time for oil refill will be some 2×80°=160°, and the time for pumping will be 360°-160°=200°. A significant but not fatal difference from Simple Harmonic Motion. However, these intervals change if the connecting rod length is different*from our own.

Specifying the exact inertial period durations in the Claims would require burdensome detail. Duration of upward inertial force for the refill process will simply be understood to be only part of the top half of rotation of the crankshaft.

Figure 7:
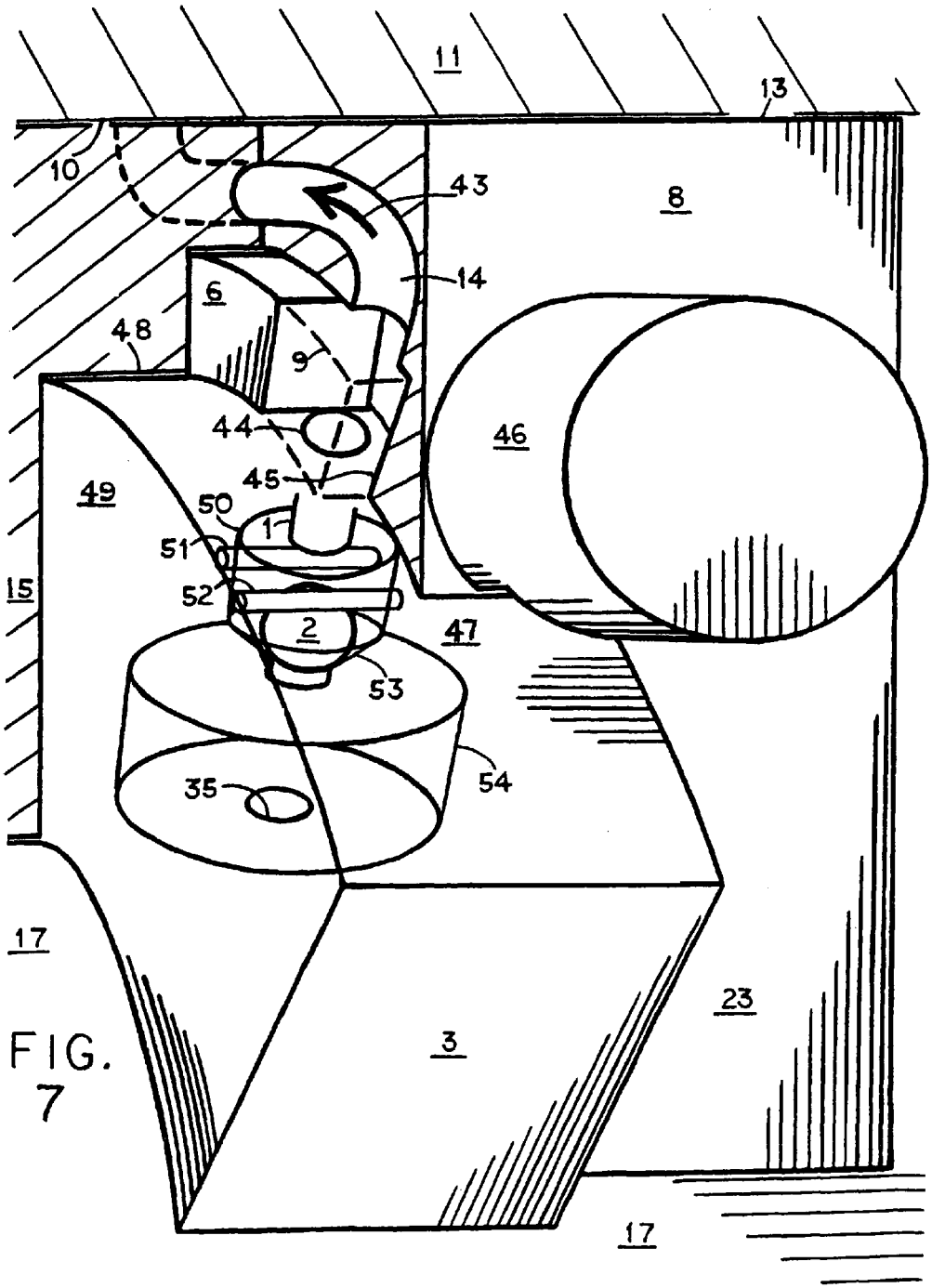
FIG. 7 is a partial cutaway elevation of the back of the saddle.

FIG. 7 shows the back of the saddle. In the enlarged view in FIG. 7, saddle 8 straddles plunger carrier 3, with upright 23 resting on connecting rod small end 17. Half of other upright 15 has been removed for this part-sectional view. Plunger 6 has swept the volume of plunger bore 9 whose end is shown as dashed lines. Oil 43 formerly in plunger bore 9 flows through duct 14 to the flat underside 10 of piston crown 11. There the high oil pressure will lift piston crown 11 slightly.

In FIG. 7, the oil which filled plunger bore 9 initially emerged from oil hole 44, which is the top of oil duct 1.

In FIG. 7, an important feature is top surface 47 of plunger carrier 3. During the normal oscillation of small end 17, plunger carrier 3 rocks back and forth under plunger bore 9. Top surface 47 slides one way then the other directly under the bottom of plunger bore 9. At this point it makes sense to consider plunger bore 9 as a channel 9 because it has no floor of its own. A transverse cross-section of channel 9 would be a square missing one of its four sides, the one at the bottom. Channel 9 has a slot there instead of a floor. Huge leakage through the slot is prevented in FIG. 7 by top surface 47 which blocks the slot and is a moving floor for channel 9. Of course, channel 9 may have a cross-section different from square.

In FIG. 7, strut 46 absorbs the push from oil pressure on channel end wall 45. Strut 46 would transmit the push to the piston skirt.

Saddle 8 in reality would be about two inches high, not the size seen in FIG. 7 except in large engines.

Some parts in the interior of plunger carrier 3 are seen in FIG. 7. The parts are drawn as if plunger carrier 3 was transparent, as with the parts themselves. The outlines are what matters. Item 50 is the check valve "body", even though it's actually a hollow cylinder full of oil and containing check valve ball 2. Ball 2 is on its seat, held there at this time mainly by the high oil pressure from the end of plunger 6's in-sweep of plunger bore 9. A conical funnel at 53 helped ball 2 find its seat inertially earlier in case check valve body 50 happened to be at an angle to the vertical.

At other times, oil will flow upward through oil hole 44 during the refill event. Ball 2 would come off its seat and move upward to rest against the two short rods 51 and 52. Short rods 51, 52 are thin enough to not impede oil flow, but they will stop ball 2 and keep it from blocking oil duct 1.

An improvement to the refill process is ready chamber 54 just upstream of check valve body 50. Ready chamber 54 has the time to fill up with oil from below during plunger 6's working stroke (the in-sweep of plunger bore 9.) Then the oil doesn't have far to travel to fill up plunger bore 9 during refill. This decreases a possible delay caused by inertia of the oil column in 35 as the oil starts to move upward once per revolution of the crankshaft. Ready chamber 54 makes it possible for the oil to flow all the time. It may avoid oil feed problems by ending interruptions.

In FIG. 7, plunger carrier 3 will be closely flanked by the two uprights 15 and 23 of saddle 8. Thus, when plunger carrier 3 moves left or right as a result of the connecting rod's side play, saddle 8 will move the same amount. This helps keep plunger 6 centered in plunger bore 9. Plunger 6 itself can be integral with plunger carrier 3, or just fastened to it. The downside of FIG. 7 is that saddle 8 represents a sizeable mass to move left or right during small end 17's side play. Therefore, the necessity of a high plunger carrier 3 so that tall side face 49 can push effectively on upright 15. With a uniform push on over half the height of saddle 8, there's a good chance saddle 8 will move left or right smoothly without scraping or tipping on piston crown underside 10.

In FIG. 7, the three walls of square cross-section channel 9, plus top surface 47 making the fourth wall, make up a working chamber. The whole plunger-swept volume is still contained in channel 9, which saves the characterization of saddle 8 as containing the plunger bore.

The planned small clearance between top surface 47 and a ceiling 48 of the large space between uprights 15 and 23 allows some small leakage. This will lubricate the moving parts, for instance carrier side wall 49 sliding past the inside wall of upright 15.

An alteration was made to flat top deck 13 of FIG. 7. A new top deck is in FIG. 8. Shallow pan 12 is carved out of the top of saddle 8. That leaves the narrow raised rim 13 which makes a complete circle around shallow pan 12. Rim 13 is what comes close to the flat surface of underside 10. Duct 14 which lets the oil under high pressure out of plunger bore 9 discharges the oil at the center of shallow pan 12. Then the oil will flow outwardly and, it is hoped evenly, in all radial directions toward new top deck 13 where it will leak out slowly. The continuous radial outflow of oil in all directions of the compass suggests that no oil will linger very long in shallow pan 12. Therefore, the oil should avoid being cooked by prolonged exposure to the temperature of piston crown 11.

The floor missing from plunger bore 9 will cause an upward push on the ceiling of plunger bore 9 from hydraulic pressure. However, the area of shallow pan 12 (FIG. 8) is much greater than the area of plunger bore 9's ceiling. There will be a net downward push on saddle 8 which keeps it firmly planted on small end 17.

Figure 8:
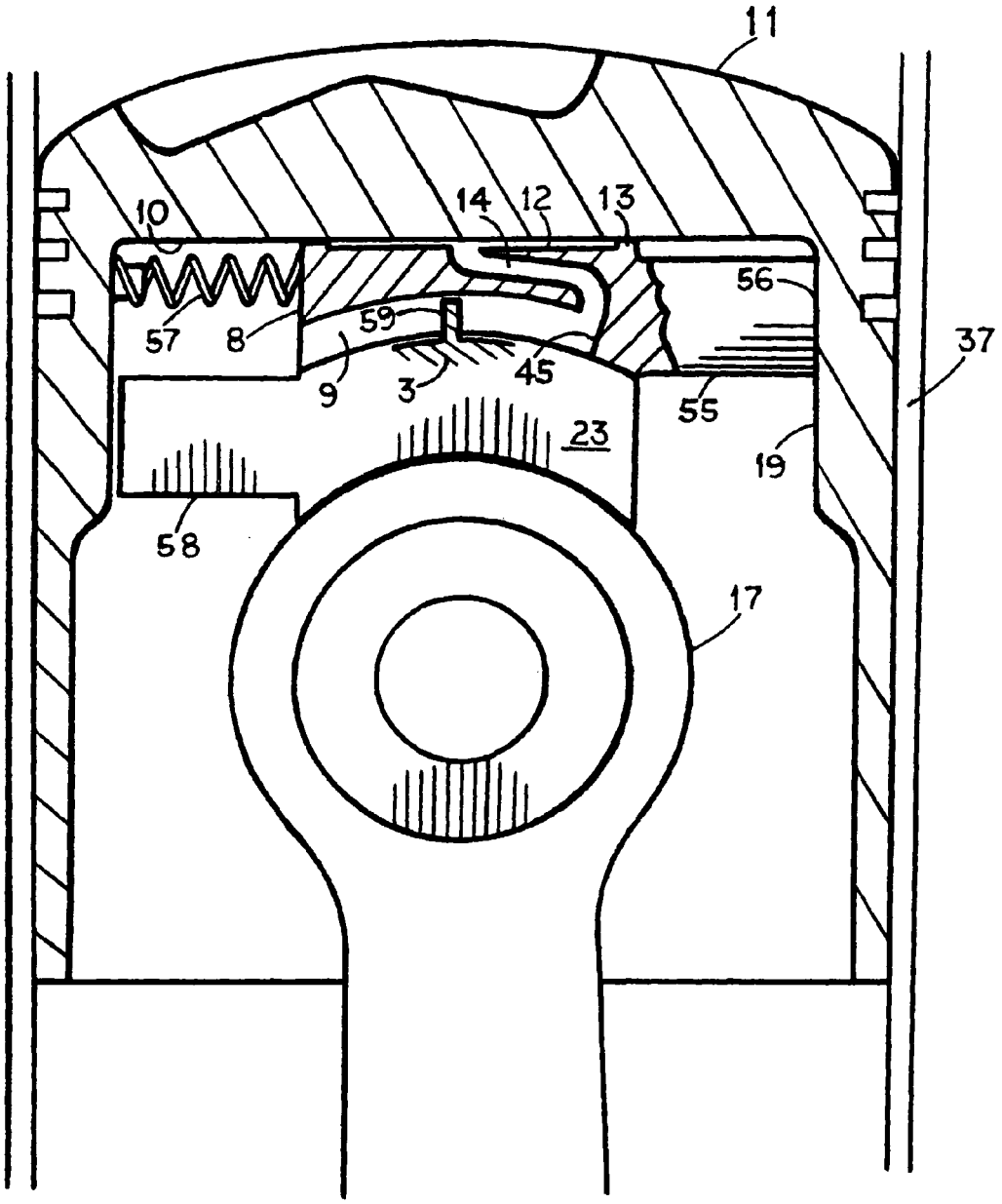
FIG. 8 is a sectional elevation of the saddle for heat transfer.

FIG. 8 shows saddle 8 in vertical cross-section through channel 9. The plunger carrier has been removed from small end 17 to reveal the saddle interior. One upright is also omitted, leaving the inside wa11 of upright 23 visible. End wall 45 of plunger bore 9 takes the push to the right from high oil pressure when the plunger is on the in-sweep. As before, the push to the right is absorbed by a strut, 55 in FIG. 8, which transmits the push to piston skirt 19; in order to keep saddle 8 from leaning right and skewing with respect to underside 10.

The advantage of short tab 59 in FIG. 8 is less sliding friction.

Strut 55 is expected to perform another function, heat transfer from saddle 8 to piston skirt 19 when the engine is shut down. This is to prevent possible cracking of some part when piston 11, 19 cools down by conduction to cylinder wall 37 faster than does the more enclosed saddle 8. Thus, strut 55 must make good contact to piston skirt 19 at area 56. Spring 57 delivering a mild but continuous push to the right can achieve that.

The weight of strut 55 could cause saddle 8 to experience unbalanced inertial forces causing tilting. Secondary strut 58 counteracts that by supplying a balancing weight. Strut 58 can be one of two issuing from the narrow uprights, to add up to sufficient weight.

Highly-boosted four-stroke cycle engines weren't mentioned, but they are not excluded from the invention.

Throughout the text, the term, "rib" was set aside in favor of the more suggestive "plunger", even though rib 6 doesn't look like a piston in typical plunger pumps. But for the Claims, nomenclature reverts to the physical parts, instead of the more operative terms used up to now. Thus, "plunger" is replaced by "rib";

"plunger carrier" is replaced by "ridge", and "plunger bore" becomes "channel".

The scope of the invention is found in the appended Claims.

The invention claimed is:

1. A piston including a wristpin;

a connecting rod having a first end and a second end, wherein the connecting rod is connected to the wristpin at the first end allowing relative rotation between the connecting rod and the piston;

a rotating crankshaft affixed to the connecting rod at the second end, wherein the rotation of the crankshaft drives a movement of the connecting rod and the piston;

a protrusion formed at the first end of the connecting rod, the protrusion including:

a ridge extending radially outward from the first end along a portion of a circumference of the first end and having a top surface, and a rib extending even further radially outward from the top surface and centrally positioned on the top surface, wherein the rib is smaller in height than the ridge;

a piston crown at the top of the piston;

a female structure arranged under the piston crown, wherein the protrusion and the female structure are complementary, and a lubricant flow lubricates an interface between the protrusion and the female structure.

2. The device of claim 1 and further comprising a piston skirt, piston pin bosses, uprights, a space, a channel, a plug, a duct, and a check valve;

the piston skirt and the piston bores located below the piston crown; the piston pin bores housing the wristpin;

a space and a channel, centered in the bottom half of the female structure, constituting the female portion of the female structure;

two uprights substantially parallel to each other and apart from each other by the width of the space;

each upright having a bottom surface shaped as an arc of a circle;

the top of the first end having a round surface on each side of the ridge;

the uprights extending downward to the top of the first end;

each bottom surface of an upright contacting one of the round surfaces;

each round surface being a journal for a bottom surface;

the channel being curved along its length, with the curve being an arc of a circle;

the protrusion, when in mesh with the female structure, putting the ridge complementarily in the space, and the rib complementarily in the channel, thereby creating the interface subject to the lubrication flow;

the first end of the connecting rod rotationally oscillating centered on the wristpin;

the ridge and the rib rotationally oscillating in the space and the channel respectively;

the rib reciprocating arcuately within the channel, exhibiting an in-stroke and an out-stroke;

the channel having a front end and a back end; the channel being closed at the back end by the plug, but open at the front end which is the side the rib is located;

the rib being shorter than the ridge; part of the top surface of the ridge providing a moving floor for the channel's back end;

a fluid exit from the channel at the back end being the duct;

the duct running upward in the female structure;

the channel communicating with the check valve controlling the flow of the lubricant;

the check valve allowing lubricant flow into the channel during the out-stroke of the rib;

the check valve closed to backflow through the check valve during the rib's in-stroke;

the top of the female structure being adjacent to the piston crown;

the rib's in-stroke pressurizing the lubricant, delivering higher-pressure oil through the duct to the top of the female structure;

the higher-pressure oil pushing up on the piston crown, lifting the piston pin bores incrementally relative to the wristpin and creating a gap above the wristpin; and lubricant entering the gap once per revolution of the crankshaft.

3. The device of claim 2 and further comprising a strut;

the higher-pressure oil, bounded at the back end of the channel by the plug, exerting a push on the female structure toward the rear of the female structure; and the strut, spanning the distance from the female structure to the piston skirt, transmitting the push to the piston skirt.

4. The device of claim 2 wherein the plug is integral with the female structure.

5. The device of claim 4 and further comprising a strut;

the higher-pressure oil, bounded at the back end of the channel by the plug, exerting a push on the female structure toward the rear of the female structure; and the strut, spanning the distance from the female structure to the piston skirt; transmitting the push to the piston skirt.

* * * * *